US005189995A

United States Patent [19]

Hooper

[11] Patent Number: 5,189,995

[45] Date of Patent: Mar. 2, 1993

[54] STEPPED PISTON ENGINE

[76] Inventor: Bernard Hooper, High Woodland, Littlegain, Hilton, Nr. Bridgnorth Shropshire, Great Britain, WV15 5PA

[21] Appl. No.: 768,401

[22] PCT Filed: Mar. 19, 1990

[86] PCT No.: PCT/GB90/00410

§ 371 Date: Oct. 16, 1991

§ 102(e) Date: Oct. 16, 1991

[87] PCT Pub. No.: WO90/11436

PCT Pub. Date: Oct. 4, 1990

[30] Foreign Application Priority Data

Mar. 18, 1990 [GB] United Kingdom ..... 8906278

[51] Int. Cl.[5] ..... F02B 75/20

[52] U.S. Cl. ..... 123/59 BS; 123/65 S

[58] Field of Search ..... 123/59 BS, 73 B, 65 S

[56] References Cited

U.S. PATENT DOCUMENTS

| | | | |
|---|---|---|---|
| 1,465,885 | 8/1923 | Wege | 123/59 BS |
| 1,624,583 | 4/1927 | Burtnett | 123/59 BS |
| 1,624,584 | 4/1927 | Burtnett | 123/59 BS |
| 2,230,308 | 2/1941 | Olds | 123/59 BS |

FOREIGN PATENT DOCUMENTS

| | | | |
|---|---|---|---|
| 249961 | 4/1910 | Fed. Rep. of Germany . | |
| 398900 | 8/1921 | Fed. Rep. of Germany . | |
| 803961 | 4/1951 | Fed. Rep. of Germany | 123/73 B |

*Primary Examiner*—David A. Okonsky

*Attorney, Agent, or Firm*—Pearne, Gordon, McCoy & Granger

[57] ABSTRACT

A stepped piston engine comprises first (10), second (11) and third (12) stepped cylinders, each cylinders (10,11,12) having a larger diameter pumping part (10*p*,11*p*,12*p*), and a smaller diameter working part (10*w*,11*w*,12*w*), and a piston (13,14,15) slidable in the cylinder, each piston (13,14,15) being coupled to an output shaft (16) of the engine, first transfer passage means (20) to transfer the precompressed charge from the larger diameter pumping part (10*p*) of the first cylinder (10) to the smaller diameter working part (11*w*) of the second cylinder (11), second transfer passage means (21), to transfer precompressed charge from the larger diameter pumping part (11*p*) of the second cylinder (11) to the smaller diameter working part (124) of the third cylinder (12), and third transfer passage means (22) to transfer precompressed charge from the larger diameter pumping part (12*p*) of the third cylinder (12) to the smaller diameter working part (10*w*) of the first cylinder (10).

20 Claims, 4 Drawing Sheets

STEPPED PISTON ENGINE

DESCRIPTION OF INVENTION

This invention relates to a stepped piston engine.

According to the invention 1 provide a stepped piston engine comprising first, second and third stepped cylinders, each cylinder having a larger diameter pumping part, and a smaller diameter working part, and a piston slidable in the cylinder, each piston being coupled to an output shaft of the engine, first transfer passage means to transfer precompressed charge from the larger diameter pumping part of the first cylinder to the smaller diameter working part of the second cylinder, second transfer passage means to transfer precompressed charge from the larger diameter pumping part of the second cylinder to the smaller diameter working part of the third cylinder, and third transfer passage means to transfer precompressed charge from the larger diameter pumping part of the third cylinder to the smaller diameter working part of the first cylinder.

The charge may comprise air, or a mixture of air and fuel.

The invention will now be described with reference to the accompanying drawings in which.

Figure 1:
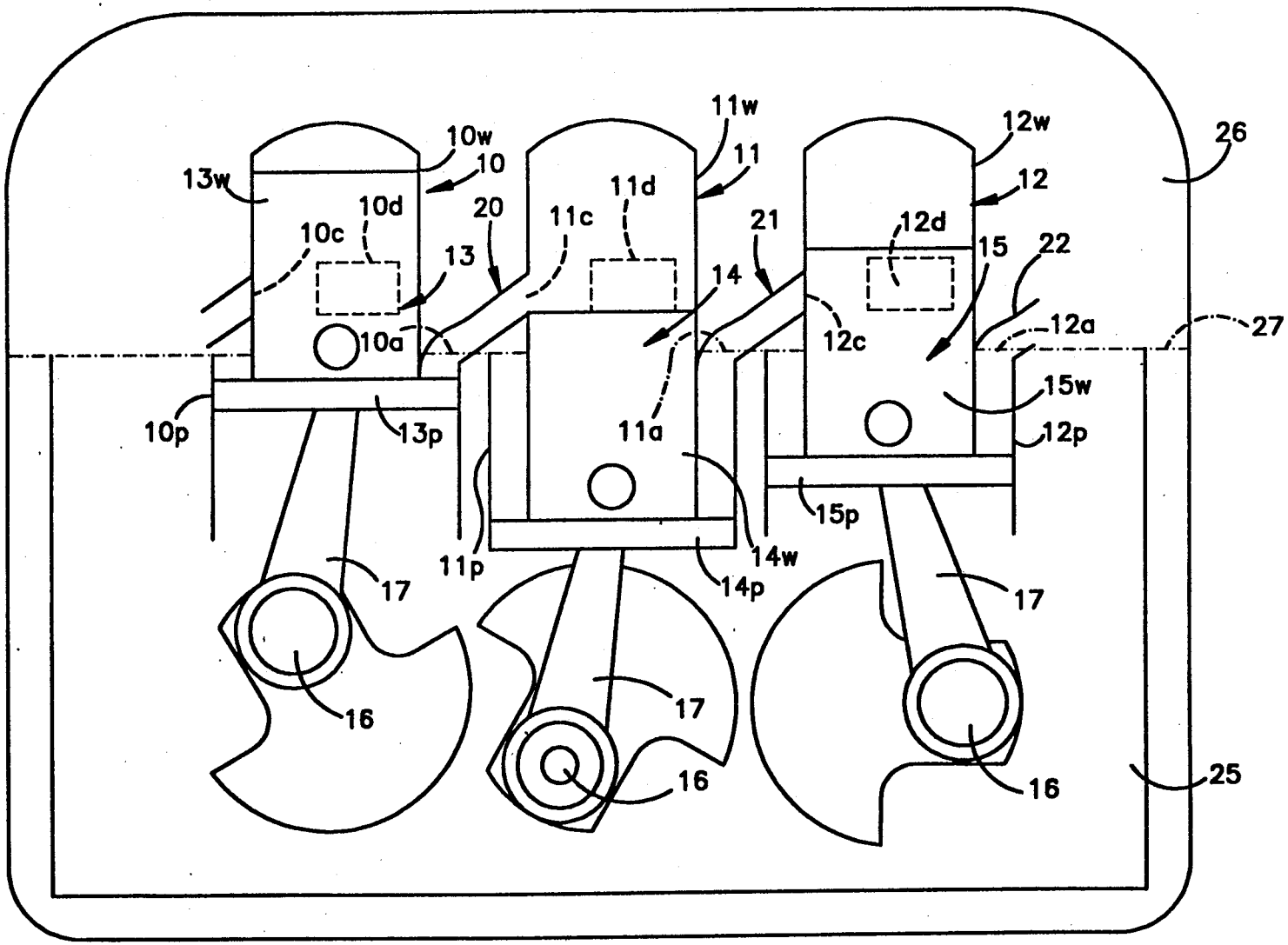
FIG. 1 is an illustrative side view of an engine in accordance with the invention with the pistons shown at 90° to their true positions, so as to illustrate the phase relationship between the pistons and the operating cycle of the engine.
Figure 2:
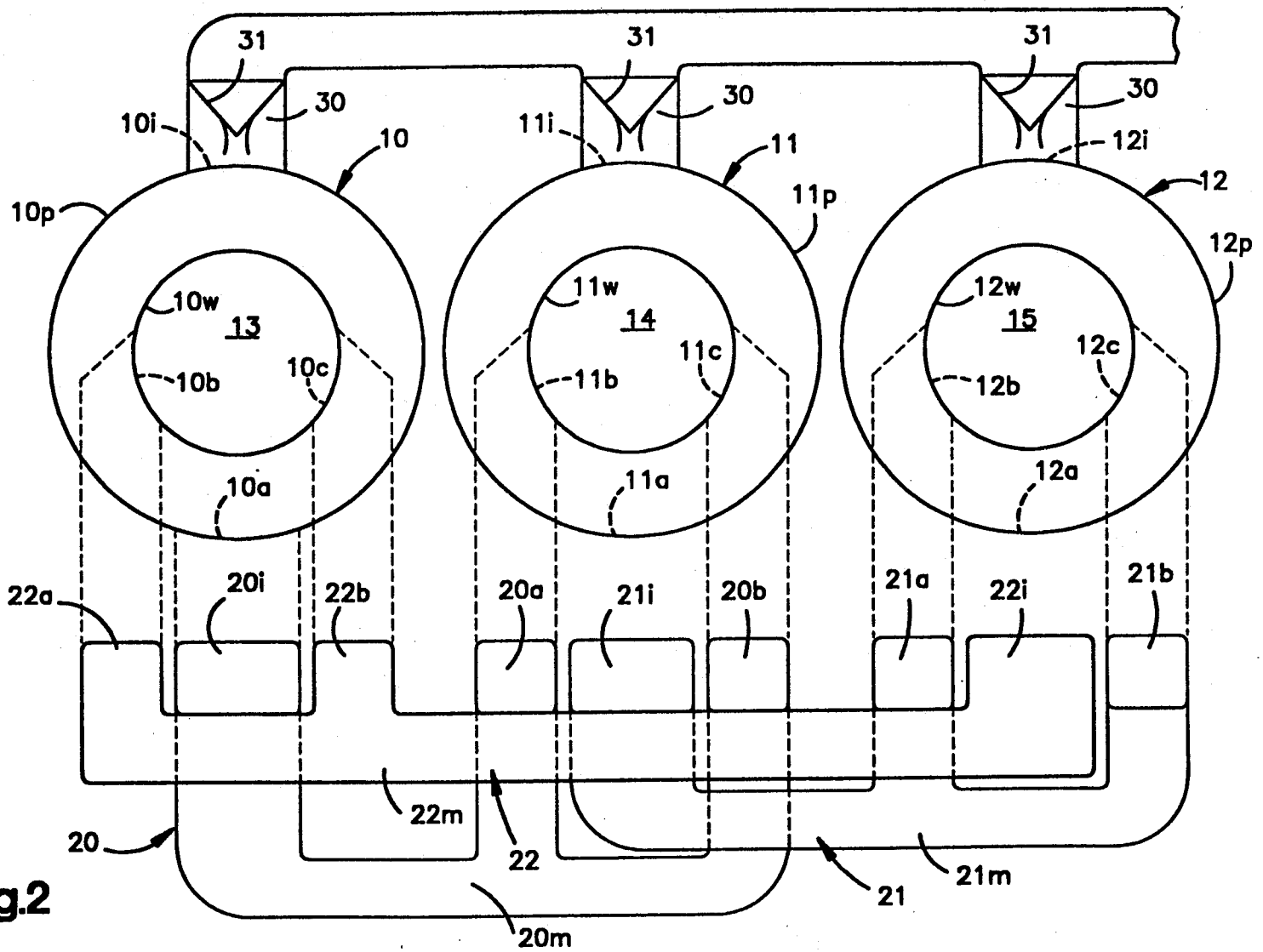
FIG. 2 is an illustrative plan view of an engine in accordance with the invention, showing the arrangement of transfer passage means between the cylinders.
Figure 3:
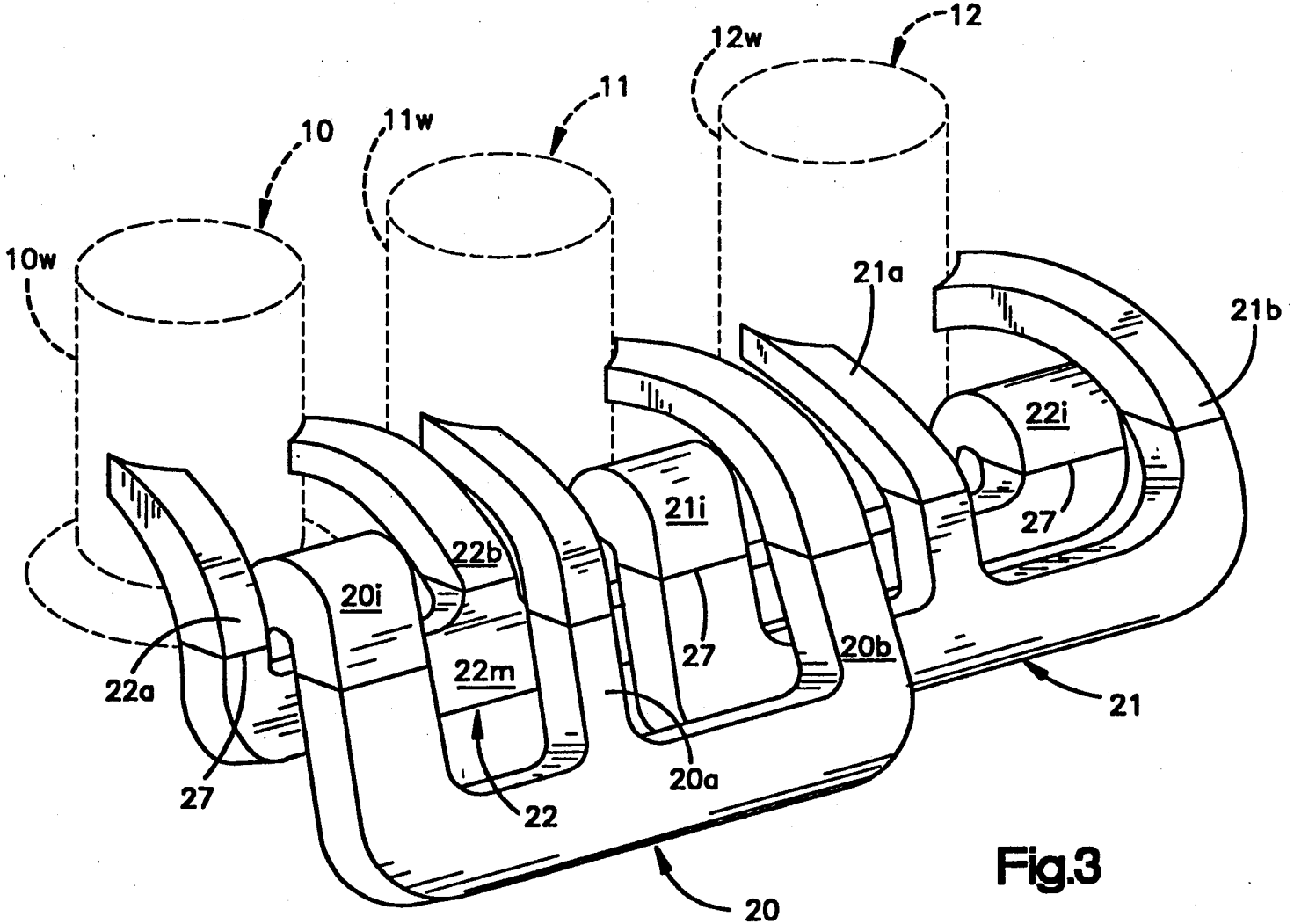
FIG. 3 is an illustrative perspective view of part of an engine of the invention showing in perspective a possible layout of transfer passages.

Referring first to FIGS. 1 to 3 of the drawings, a stepped pist engine comprises first, second and third cylinders 10, 11, 12, each cylinder being of stepped configuration having a larger diameter pumping part 10*p*,11*p*,12*p* and a smaller diameter working part 10*w*,11*w*,12*w* and a respective piston 13,14,15, slidable therein.

Each piston has a larger diameter part 13*p*,14*p*,15*p*, generally of corresponding dimension to the larger diameter pumping part 10*p*,11*p*,12*p*, of the respective cylinders 10,11,12, with appropriate piston rings (not shown) received in grooves in the pumping parts 10*p*,11*p*,12*p*, and a smaller diameter part 13*w*,14*w*,15*w* generally of corresponding diameter to the smaller diameter working parts 10*w*,11*w*,12*w* of the respective cylinders 10,11,12, again with appropriate piston rings (not shown) received in grooves in the working parts 13*w*,14*w*,15*w*.

Each of the pistons 13,14,15, is connected to a common crank shaft 16 which comprises an output shaft from the engine, by respective connecting rods 17, as is well known in the art.

The first cylinder 10 comprises an outlet part 10*a* which communicates with the larger diameter pumping part 10*p* leading to a first transfer passage means 20 which comprises an inlet passage part 20*i* which communicates with the part 10*a*, and a main passage part 20*m* from which a pair of branches 20*a*,20*b*, extend. The branches 20*a*,20*b* extend to opposite sides of the smaller diameter working part 11*w* of the second cylinder 11 with which they communicate by respective parts 11*b*,11*c*.

The second cylinder 11 comprises an outlet part 11*a* which communicates with the larger diameter pumping part 11*p* and leads to a second transfer passage means 21 which comprises an inlet passage part 21*i* which communicates with the part 11*a* and a main passage part 21*m* from which a pair of branches 21*a*,21*b* extend. The branches 21*a*,21*b*, extend to opposite sides of the smaller diameter working part 12*w* of the third cylinder 12 with which they communicate via respective parts 12*b*,12*c*.

The third cylinder 12 comprises an outlet port 12*a* which communicates with the larger diameter pumping part 12*p* leading to a third transfer passage means 22 which comprises an inlet passage part 22*i* which communicates with the part 12*a* and a main passage part 22*m* from which a pair of branches 22*a*,22*b* extend. The branches 22*a*,22*b*, extend to opposite sides of the smaller diameter working part 10*w* of the first cylinder 10 with which they communicate via respective ports 10*b*,10*c*.

The engine comprises a crank case 25 and a cylinder block 26 common to all three cylinders 10,11,12, although if desired, a separate cylinder block may be provided for each of the cylinders. The crank case 25 and cylinder block 26 or blocks, are connected at an interface 27 at a junction between the larger diameter pumping parts 10*p*,11*p*,12*p*, and the smaller diameter working parts 10*w*,11*w*,12*w* of the cylinders 10,11,12.

In the example described, the outlet ports 10*a*,11*a*,12*a* are at the interface 27 with the inlet passage parts 20*i*,21*i*,22*i* extending upwardly into the cylinder block 26, then down again across the interface 27 to the respective main passage part 20*m*,21*m*,22*m* each which, in this example, is contained wholly within the crank case 25.

It can be seen from FIGS. 2 and 3 that the inlet passage part 20*i* crosses the interface 27 with the branches 22*a*,22*b* either side, whilst the inlet passage part 21*i* crosses the interface 27 with the branches 20*a*,20*b* either side, and the inlet passage part 22*i* crosses the interface 27 with the branches 21*a*,21*b* either side.

The cylinders 10,11,12, also each have an inlet port 10*i*,11*i*,12*i* which communicates with a respective larger diameter pumping part 10*p*,11*p*,12*p*, to which parts charge is supplied from a respective supply passage 30, each of the respective supply passages 30 containing a one-way valve such as a reed valve 31, so that charge may be drawn into the cylinder part 10*p*,11*p*,12*p* during downward movement of the respective piston 13,14,15, but is prevented from passing back into the supply passage 30 during precompression i.e. when the respective piston 13,14,15, is moving upwardly.

It will be noted from FIG. 1, that the pistons 13,14,15, are 120° out of phase with one another.

The working cycle of the engine will now be described.

Piston 13 is shown in FIG. 1 in cylinder 10 moving upwardly at a position just before reaching top dead-centre. Charge, comprising a mixture of air and fuel, during the upward movement of the piston 10, has been compressed in the larger diameter pumping part 10*p* and transferred via the first transfer passage means 20 to the smaller diameter working part 11*w* of cylinder 11, when the inlet ports of the branches 20*a*,20*b* are uncovered by piston 14 in the second cylinder 11.

At the same time, precompressed charge, previously introduced into the smaller diameter working part 10*w* of cylinder 10 is further compressed by the upward movement of the piston 13, once the piston has passed and hence blocked the inlet ports 10*b*,10*c* (only one of which is shown in FIG. 1) which communicate with the branches 22*a*,22*b* of the third transfer passage means 22.

When piston 13 reaches top dead-centre, ignition will occur.

In a diesel engine, such as that shown, the charge will spontaneously ignite, but in a petrol engine, a spark plug would be required to initiate combustion.

When piston 13 is in the position shown, piston 14 will just be commencing its upward movement. While piston 14 is below the inlet ports 11*b*,11*c*, from the branches 20*a*,20*b* of the first transfer passage means 20, the precompressed charge from the larger diameter pumping part 10*p* is pumped into the smaller diameter working part 11*w*, but when the parts 11*b*,11*c* are blocked as the piston 14 continues to move upwardly, the precompressed charge in the smaller diameter working part 11*w* will be further compressed by the further upward movement of the piston 14, until the piston 14 reaches top dead-centre when ignition will occur in cylinder 11.

Whilst pistons 13,14, are in the positions shown, piston 15 is moving downwardly by virtue of fully compressed charge in smaller diameter working part 12*w* of cylinder 12 having been previously ignited.

As piston 15 continues to move downwardly, an exhaust port 12*d* of the cylinder 12 will be unblocked, as will the inlet ports 12*b*,12*c* connected to the branches 21*a*,21*b*, of the second transfer passage means 21, so that charge precompressed by the upward movement of piston 14 can be pumped into the smaller diameter working part 12*w* of cylinder 12 at the same time flushing the combustion products from the smaller diameter working part 12*w* via the exhaust port 12*d*.

Further, whilst piston 15 is moving downwardly, charge will be drawn into the larger diameter pumping part 12*p* via the inlet port 12*i* connected to the supply passage 30.

Thus in each case, as the pistons 13,14,15, move downwardly fresh charge is drawn into the larger diameter pumping part 10*p*,11*p*,12*p* and at least when the respective inlet ports 10*b*,10*c*; 11*a*,11*c*; 12*b*,12*c* are uncovered by the pistons 13,14,15, precompressed charge is pumped into the smaller diameter working parts 10*w*,11*w*,12*w* at the same time flushing combustion products from the cylinders 10,11,12, via exhaust ports 10*d*,11*d*,12*d*.

As the pistons 13,14,15, move upwardly, charge in the larger diameter pumping part 10*p*,11*p*,12*p* is precompressed, and at least when the respective inlet 10*b*,10*c*; 11*b*,11*c*, 12*b*,12*c* and exhaust ports 10*d*;11*d*;12*d* are closed by the pistons 13,14,15, the precompressed charge is further compressed until the pistons 13,14,15, reach top dead-centre when ignition will occur.

It will be appreciated from FIGS. 2 and 3 that the main passage part 22*m* at least is considerably longer than the main passage parts 20*m*,21*m*, which are of generally equal length, and so the third transfer passage means 22 would appear to have a greater volume than each of the first and second transfer passage means 20,21.

However this would lead to inefficient transfer of precompressed charge from cylinder 12 to cylinder 10, and result in engine imbalance.

Hence the first, second and third transfer passage means 20,21,22, are arranged to have generally equal volumes, or at least volumes within a variation of 25% of each other, more preferably within a variation of 15% of each other, and yet more preferably within a variation of 10% of one another.

This arrangement has been found to allow for efficient charge transfer overall, and a balanced engine.

Generally equal volumes may be achieved by reducing the average cross sectional area of the third transfer passage means 22 by reducing the actual cross sectional area over at least part of its length, but this can lead to engine inbalance.

Alternatively, the lengths of the branches 20*a*,20*b*,-21*a*,21*b* may be made longer than the branches 22*a*,22*b*, the longer branches relatively increasing the volumes of the first and second transfer passage means 20,21, to allow for the longer main passage part 22*m* of the third transfer passage means 22 so that the combined lengths of the main passage parts (20*m*,21*m*,22*m*) and branches (20*a*,20*b*;21*a*,21*b*;22*a*,22*b*) and the inlet passage parts (20;21;22) of all the transfer passage means 20,21,22 are generally equal, so that the transfer passage means 20,21,22 each have generally the same volume.

In a preferred embodiment, the branches 20*a*,20*b*; 21*a*,21*b*; 22*a*,22*b*, are all of generally equal length, or at least have lengths within a variation of 25%, or more preferably within 15% of each other, and the main passage parts 20*m*,21*m*, being of generally equal length and necessarily shorter than the main passage part 22*m*. Thus to ensure generally equal volumes within the first, second and third transfer passage means 20,21,22, the inlet passage parts 20*i*,21*i* and 22*i* are of differing lengths.

It can be appreciated from FIGS. 2 and 3 that the main passage part 22*m* lies alongside the cylinders 10,11,12, so that inlet passage part 22*i* is considerably shorter than each of the inlet passage parts 20*i* and 21*i*.

In the example shown, the second transfer passage means 21 is nested between the first and third transfer passage means 20 and 22.

Of course, other transfer passage means arrangements are possible. For example the average cross sectional area of the third transfer passage means 22 may be slightly reduced and the branches 20*a*,20*b*,21*a*,21*b* of the first and second transfer passage means 20,21, may be made longer than the branches 22*a*,22*b* of the third transfer passage means 22, whereby the volumes of the first, second and third transfer passage means 20,21,22, may be made generally equal.

Various other modifications may be made without departing from the scope of the invention.

For example, the inlet ports 10*b*,10*c*; 11*b*,11*c*; 11*b*,12*c* for the smaller diameter working parts 10*w*,11*w*,12*w* of each of the cylinders 10,11 and 12 are shown in the example described, generally opposite one another, with the exhaust outlet ports 10*a*,11*a*,12*a* and inlet ports 10,11,12, generally on opposite sides but spaced 90° from the inlet ports 10*b*,10*c*,11*b*,11*c*,12*b*,12*c*. This port arrangement has been found to provide for efficient scavenging of combustion products from the engine, although other port configurations are no doubt possible.

In the example described, the main passage parts 20*m*,21*m* and 22*m* of the first, second and third transfer passage means 20,21,22, are all contained within the crank case 25 but need not be in an alternative arrangement.

Figure 4:
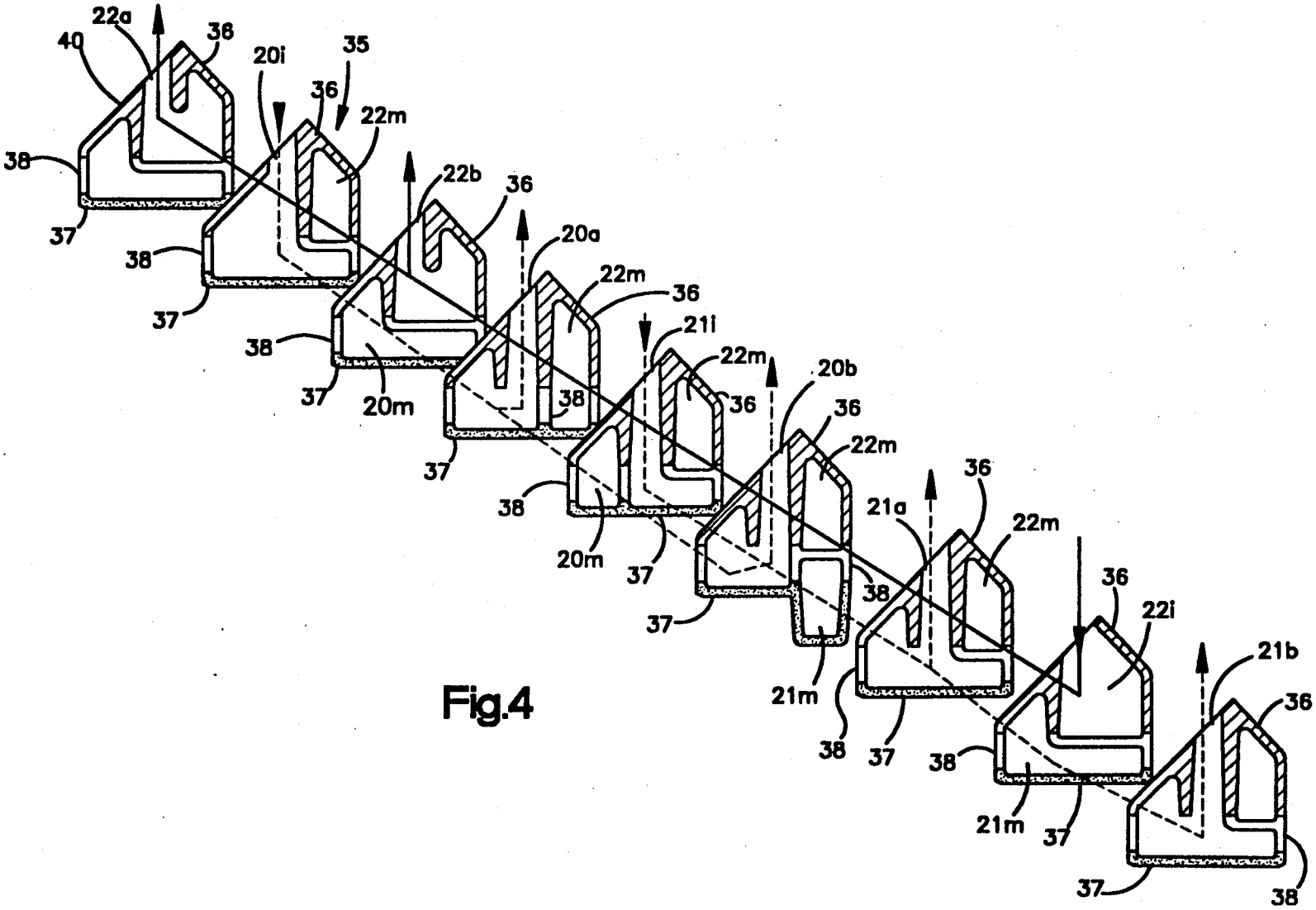
FIG. 4 is a series of cross sections taken through a practical version of a manifold which may provide the transfer passage layout of FIG. 3.

For example, referring to FIG. 4, a manifold 35 is provided which bridges the interface 27 between the crankcase 25 and the cylinder block or blocks 26. The manifold 35 wholly contains each of the main passage parts 20*m*,21*m*,22*m* of the transfer passage means 20,21,22, and contains portions of each of the branches 20*a*,20*b*; 21*a*,21*b*; 22*a*,22*b* and further portions of each of the inlet passage means 20*i*,21*i*,22*i*. The remaining portions of the branches 20*a*,20*b*;21*a*,21*b*;22*a*,22*b*, are contained in the or the respective cylinder block 26, whereas the remaining portions of the inlet passage parts 20*i*,21*i*,22*i* are contained within the crankcase 25, so that the respective passage parts extend to the ports 11*b*,11*c*;12*b*,12; 10*b*,10*c*; and 10*a*,11*a*,12*a*.

The manifold 35 is made up of a main part 36 (cross hatched for clarity) and a cover plate 37 (stippled for clarity) with a sandwich plate 38 therebetween. The main part 36 and sandwich plate 38 together provide a recess comprising parts of branches 22*a*,22*b*, part of main passage part 22*m*, and part of the inlet passage means 22*i* of the transfer passage means 22. Between the sandwich plate 38 and cover plate 37, a further recess is provided comprising part of the main passage part 21*m* of the transfer passage means 21. Between the main part 36 and cover plate 37, a yet further recess is provided, which is divided by the sandwich plate 38 to provide part of inlet passage part 20*i*, main passage part 20*m* and parts of branches 20*a*,20*b* of the transfer passage means 20, part of inlet passage part 21*i*, part of main passage part 21*m* and parts of branches 21*a*,21*b* of transfer passage means 21, and part of main passage part 22*m*. The manifold joint face 40 is preferably inclined at about 45° as shown.

Such a construction is preferred because manufacture of the manifold 35 by diecasting is facilitated as it is possible to provide draft on each side face of the main passage parts 20*m*,21*m*,22*m*, and portions of the other passage parts, in the manifold 35.

Preferably, at least a proportion of the main part 36 of the manifold is an integral part of the crankcase 25 of the engine.

The engine in the example described has only three cylinders 10,11,12, but may have more than three cylinders arranged in groups of three, either all in line, or in a V configuration with the three cylinders of each group of three all on one side of the V, but preferably all of the pistons 13,14,15 within the or the groups of three cylinders 10,11,12 are connected to a common output shaft 16.

In the example described, charge introduced into the larger diameter pumping parts 10*p*,11*p*,12*p* of the cylinders 10,11,12, comprises a mixture of air and fuel but could in a different arrangement comprise air alone, with fuel or a mixture of air and fuel being injected or otherwise introduced into the smaller diameter working parts 10*w*,11*w*,12*w* of the cylinders 10,11,12 by an injector means, just prior to ignition.

In a further modification, if desired there may be more than two inlet branches 20*a*,20*b*, 21*a*,21*b*,22*b* for each cylinder, leading to more than two inlet ports in each cylinder.

Instead of the engine having an interface as indicated at 27 between the or each cylinder block 26 and the crank case 25, the various passages may be cast without having to cross such an interface.

The features disclosed in the foregoing specification or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A stepped piston engine comprising first, second and third stepped cylinders, each cylinder being stepped and having a larger diameter pumping part, and a smaller diameter working part, and a piston slidable in the cylinder, means coupling each piston to an output shaft of the engine, first transfer passage means to transfer pre-compressed charge from the larger diameter pumping part of the first cylinder to the smaller diameter working part of the second cylinder, second transfer passage means to transfer pre-compressed charge from the larger diameter pumping part of the second cylinder to the smaller diameter working part of the third cylinder, and third transfer passage means to transfer pre-compressed charge from the larger diameter pumping part of the third cylinder to the smaller diameter working part of the first cylinder, the first, second and third transfer passage means each having volumes within a variation of 25% of each other, wherein each of said transfer passage means comprises an inlet passage part, a main passage part, and at least two branches extending from the main passage part, the combined lengths of the main passage part, the branches and the inlet passage part for each of the transfer passage means being generally equal.

2. An engine according to claim 1, wherein the first, second, and third transfer passage means have volumes within a variation of 15% of each other.

3. An engine according to claim 2, wherein the first, second, and third transfer passage means have volumes within a variation of 10% of each other.

4. An engine according to claim 1 wherein each inlet passage part extends from the respective larger diameter pumping part to said main passage part, and said at least two branches provide a pair of branches extending from said main passage part and communicating with the respective smaller diameter working part.

5. An engine according to claim 4, wherein the branches communicate with the respective smaller diameter working part of the respective cylinder generally oppositely to one another.

6. An engine according to claim 1, wherein the first, second and third cylinders are arranged generally in line with their respective cylinder axes at least substantially contained within a common plane.

7. An engine according to claim 6 wherein the average cross sectional area of the third transfer passage means is reduced compared with the average cross sectional area of the first and second transfer passage means, such that the first, second and third transfer passage means have volumes within a variation of 25% or less, of each other.

8. An engine according to claim 1, wherein the inlet passage part of the third transfer passage means is shorter than the inlet passage parts of the first and second transfer passage means but the branches of each of the first, second and third transfer passage means have generally the same length within a variation of less than 25% of each other.

9. An engine according to claim 4, wherein the three cylinders are in line and the main passage part of the third transfer passage means runs closer to the cylinders than the main passage parts of each of the first and second transfer passage means.

10. An engine according to claim 1, wherein the engine comprises a crank case and at least one cylinder block, the crank case and cylinder block being connected together at an interface, the interface being arranged at or adjacent the junction between the larger and smaller diameter parts of at least one of the cylinders.

11. An engine according to claim 10, wherein the first, second and third transfer passage means each cross the interface, with at least a major portion of each main passage part contained wholly within the crank case.

12. An engine according to claim 10, wherein an interface is provided between the at least one cylinder block and the crankcase, but a manifold is provided which wholly contains at least the main passage part of one of the first, second and third passage parts.

13. An engine according to claim 12, wherein the manifold also contains at least a portion of each of the inlet passage parts, and a portion of each of the branches of each of the transfer passage means.

14. An engine according to claim 12, wherein the manifold comprises a main part having a recess which is closed on one side by a first external cover plate, and on another side by a sandwich plate, to provide the main passage part of the third transfer passage means, and a second cover plate to provide with the sandwich plate, the main passage parts of the first and second transfer passage means.

15. An engine according to claim 12, wherein the manifold and cylinder block or blocks join, parts of the inlet passage parts and branches of all of the transfer passage means, are arranged along a line parallel with a plane containing the cylinder axes of all three cylinders.

16. An engine according to claim 12, wherein the branches of the third transfer passage means are arranged to cross the interface, either side of the inlet passage part which provides for precompressed charge to leave the first cylinder and enter the main passage part of the first transfer passage means, and the branches of the first transfer passage means are arranged to cross the interface either side of an inlet passage part which provides for precompressed charge to leave the second cylinder and enter the main passage part of the second transfer passage means, and the branches of the second transfer passage means are arranged to cross the interface either side of an inlet passage part which provides for precompressed charge to leave the third cylinder and enter the main passage part of the third transfer passage means.

17. An engine according to claim 1, wherein the engine comprises a multiple of three cylinders arranged in line in groups of three.

18. An engine according to claim 1, wherein the pistons of the three cylinders, or each group of three cylinders, are arranged to operate 120° out of phase with each other.

19. An engine according to claim 13 wherein the remaining portions of each of the inlet passage parts are contained within the crankcase, and the remaining portions of each of the branches are contained within the cylinder block.

20. An engine according to claim 1, wherein the engine comprises a multiple of three cylinders arranged in a V formation, with the three cylinders of each group on one side of the V only, with all of the respective pistons connected to a common output shaft of the engine.

* * * * *

UNITED STATES PATENT AND TRADEMARK OFFICE

CERTIFICATE OF CORRECTION

PATENT NO. : 5,189,995

DATED : March 2, 1993

INVENTOR(S) : Bernard Hooper

It is certified that error appears in the above-indentified patent and that said Letters Patent is hereby corrected as shown below:

On the title page, Section [30] Foreign Application Priority Data should read:

--March 18, 1989 [GB] United Kingdon.....8906278--.

Column 1, line 41, delete "pist" and insert --pistion--.

Delete "part" and insert --port-- at each of the following occurrences:

Column 1, line 62.
Column 2, line 4.
Column 2, line 17.

Column 1, line 66, delete "part" (first occurrence) and insert --port--.

Delete "parts" and insert --ports at each of the following occurrences:

Column 2, line 2.
Column 2, line 12.
Column 3, line 17.

Column 2, line 8, delete "part" (first occurrence) and insert --port--.

Column 7, line 27 (claim 14, line 6) delete "to provide".

UNITED STATES PATENT AND TRADEMARK OFFICE

CERTIFICATE OF CORRECTION

PATENT NO. : 5,189,995

DATED : March 2, 1993

INVENTOR(S) : Bernard Hooper

It is certified that error appears in the above-indentified patent and that said Letters Patent is hereby corrected as shown below:

Column 7, line 28, (claim 14, line 7) before "the" (first occurrence) insert --to provide--.

This certificate supersedes the Certificate of Correction issued on February 8, 1994.

Signed and Sealed this

Fifth Day of April, 1994

Bruce Lehman

*Attest:*

BRUCE LEHMAN

*Attesting Officer*

*Commissioner of Patents and Trademarks*